US010895359B2

(12) United States Patent
Abe

(10) Patent No.: US 10,895,359 B2
(45) Date of Patent: Jan. 19, 2021

(54) VEHICLE LAMP

(71) Applicant: Ichikoh Industries, Ltd., Isehara (JP)

(72) Inventor: Toshiya Abe, Isehara (JP)

(73) Assignee: Ichikoh Industries, Ltd., Isehara (JP)

( * ) Notice: Subject to any disclaimer, the term of this patent is extended or adjusted under 35 U.S.C. 154(b) by 0 days.

(21) Appl. No.: 16/633,759

(22) PCT Filed: Jul. 26, 2018

(86) PCT No.: PCT/JP2018/028034
§ 371 (c)(1),
(2) Date: Jan. 24, 2020

(87) PCT Pub. No.: WO2019/022178
PCT Pub. Date: Jan. 31, 2019

(65) Prior Publication Data

US 2020/0208800 A1 Jul. 2, 2020

(30) Foreign Application Priority Data

Jul. 26, 2017 (JP) ..... 2017-144119

(51) Int. Cl.
*F21S 41/19* (2018.01)
*F21S 41/143* (2018.01)
(Continued)

(52) U.S. Cl.
CPC ..... *F21S 41/19* (2018.01); *F21S 41/143* (2018.01); *F21S 41/20* (2018.01); *F21S 45/48* (2018.01)

(58) Field of Classification Search
CPC .. F21S 41/29; F21S 41/39; F21S 41/47; F21S 41/143
See application file for complete search history.

(56) References Cited

U.S. PATENT DOCUMENTS

2012/0287658 A1* 11/2012 Tanaka ..... F21S 41/39 362/516
2015/0085523 A1* 3/2015 Gurtl ..... F21S 41/24 362/607

(Continued)

FOREIGN PATENT DOCUMENTS

JP 2015-106465 A 6/2015

OTHER PUBLICATIONS

International Search Report dated Oct. 16, 2018 in PCT/JP2018/028034 filed on Jul. 26, 2018.

*Primary Examiner* — William N Harris
(74) *Attorney, Agent, or Firm* — Oblon, McClelland, Maier & Neustadt, L.L.P.

(57) ABSTRACT

A vehicle lamp includes a light source, a lens, and an optical member provided between the lens and the light source. The light source is provided on an attachment surface of a fixing member. The attachment surface includes a pair of fixing portions provided at positions paired with the light source being interposed therebetween and a contact portion provided to protrude from the attachment surface at a position apart from the light source in a direction perpendicular to a straight line connecting two fixing portions. A protruding amount of the contact portion from the attachment surface in an optical axis direction of the light source is greater than that of the fixing portion. A pair of fixing spots provided at one edge portion of the optical member is fixed to the fixing portions, and a contact spot provided at the other edge portion contacts the contact portion.

3 Claims, 8 Drawing Sheets

(51) Int. Cl.
*F21S 41/20* (2018.01)
*F21S 45/48* (2018.01)

(56) References Cited

U.S. PATENT DOCUMENTS

| | | | | |
|---|---|---|---|---|
| 2015/0224915 | A1* | 8/2015 | Sazuka | F21S 41/39<br>362/516 |
| 2016/0076721 | A1* | 3/2016 | Meyrenaud | F21S 41/25<br>362/522 |
| 2017/0130924 | A1* | 5/2017 | Kawai | B60Q 1/143 |
| 2018/0266642 | A1* | 9/2018 | Ohno | F21S 41/141 |

* cited by examiner

VEHICLE LAMP

TECHNICAL FIELD

The present invention relates to a vehicle lamp.

BACKGROUND ART

A lens direct-light type (direct projection type) vehicle lamp configured such that light from a light source directly enters a lens and a predetermined light distribution pattern is formed by the lens and is irradiated has been known as a vehicle lamp.

In such a vehicle lamp, a plate-shaped optical member is typically provided between the light source and the lens (see, e.g., Patent Literature 1). With this configuration, the optical member blocks part of light from the light source to the lens to prevent the light from the light source from exiting from the lens through an unintended position of the lens, and therefore, irradiation in a predetermined light distribution pattern is allowed.

CITATION LIST

Patent Literature

PTL 1: Japanese Unexamined Patent Application Publication No. 2015-106465

SUMMARY OF THE INVENTION

Problems to be Solved by the Invention

In the above-described typical vehicle lamp, the optical member is provided between the lens and a fixing member configured to fix the lens, the lens and the optical member are jointly fastened to the fixing member with multiple fastening members, and two fastening members are inserted into a lower end of the optical member. Thus, in the typical vehicle lamp, there is a probability that great vibration is caused on an unfixed upper end side of the optical member, and there is a probability that such vibration provides influence on the light distribution pattern to be irradiated.

The present disclosure has been made in view of the above-described situation, and is intended to provide a vehicle lamp configured so that at an optical member provided between a light source and a lens, fixing can be made with a simple configuration and vibration can be reduced.

Means for Solving the Problem

The vehicle lamp of the present disclosure includes a light source provided on an attachment surface of a fixing member, a lens configured to forwardly irradiate light directly entered from the light source, and an optical member having a plate shape, provided between the light source and the lens. The attachment surface includes a pair of fixing portions provided at positions paired with the light source being interposed therebetween and a contact portion provided protrusively from the attachment surface at a position apart from the light source in a direction perpendicular to a straight line connecting the pair of fixing portions. A protruding amount of the contact portion from the attachment surface in an optical axis direction of the light source is greater than that of each of the pair of fixing portions. The optical member is provided with a pair of fixing spots provided at one edge portion of the optical member and a contact spot provided at the other edge portion of the optical member, the pair of fixing spots being fixed to the pair of fixing portions through a fastening member, and the contact spot contacting the contact portion.

Effect of the Invention

According to the vehicle lamp of the present disclosure, at the optical member provided between the light source and the lens, fixing can be made with the simple configuration and vibration can be reduced.

MODE FOR CARRYING OUT THE INVENTION

Hereinafter, a first embodiment of a vehicle lamp 10 as one embodiment of a vehicle lamp according to the present disclosure will be described with reference to FIGS. 1 to 8.

First Embodiment

Description of Configuration of Embodiment

The vehicle lamp 10 is used as a lamp used for a vehicle such as an automobile, and for example, is used for a headlamp or a fog lamp. The vehicle lamp 10 forms a so-called direct-light type (lens direct-light type) lamp unit configured to form a light distribution pattern of direct light from a light source (a later-described light source unit 11) by a lens 12. On each of both right and left sides of a front portion of the vehicle, the vehicle lamp 10 is provided through an upper-lower optical axis adjustment mechanism and a right-left optical axis adjustment mechanism in a lamp chamber formed in such a manner that an opening front end of a lamp housing is covered with an outer lens. The right and left vehicle lamps 10 have an identical configuration, except that the vehicle lamps 10 are in a symmetrical position relationship. For this reason, one provided on the left side will be described hereinafter. In description below, in the vehicle lamp 10, a vehicle traveling direction upon advancement is a front-rear direction, the vertical direction in a state in which the vehicle lamp 10 is mounted on the vehicle is an upper-lower direction, and a direction perpendicular to the front-rear direction and the upper-lower direction is a right-left direction.

Figure 1:
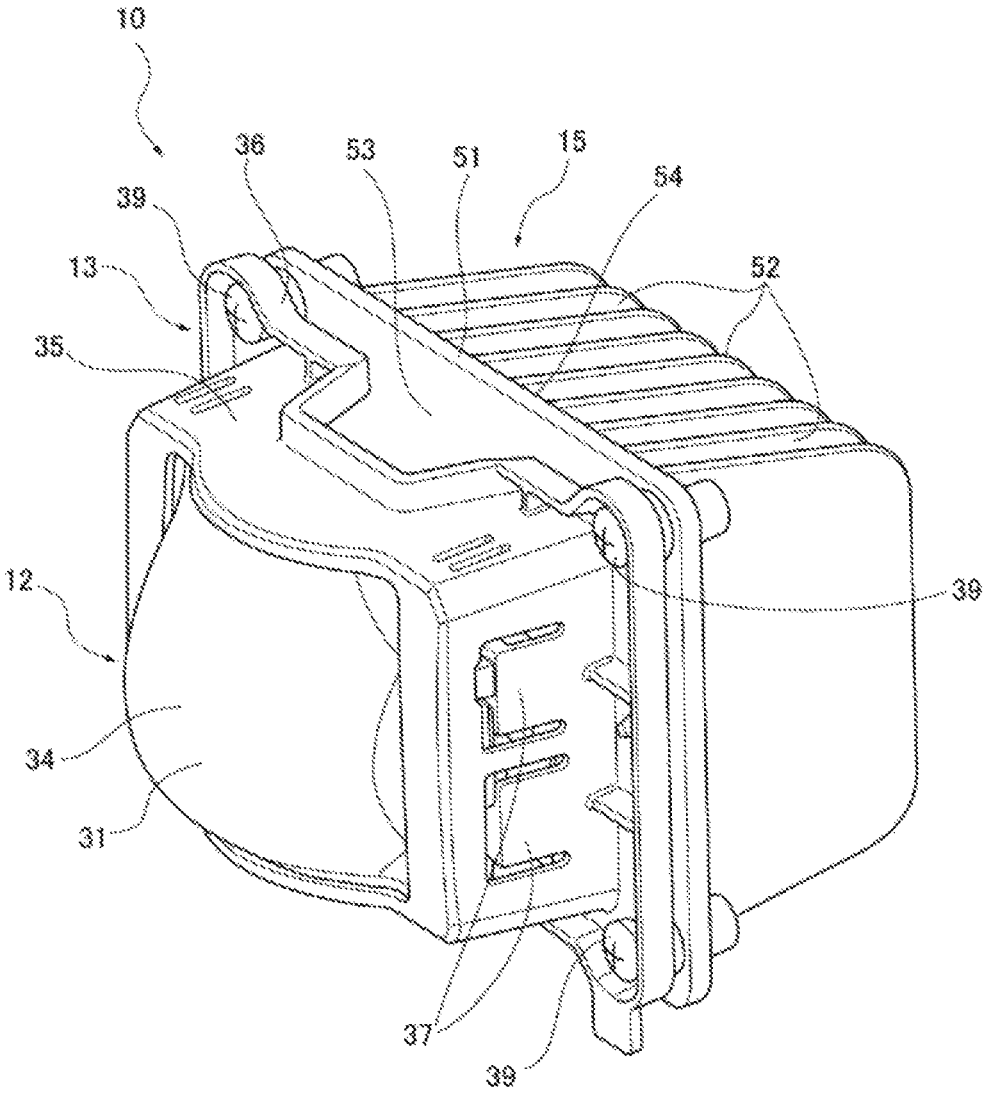
FIG. 1 is a view for describing the configuration of a vehicle lamp as one example according to one embodiment of a vehicle lamp according to the present disclosure.
Figure 2:
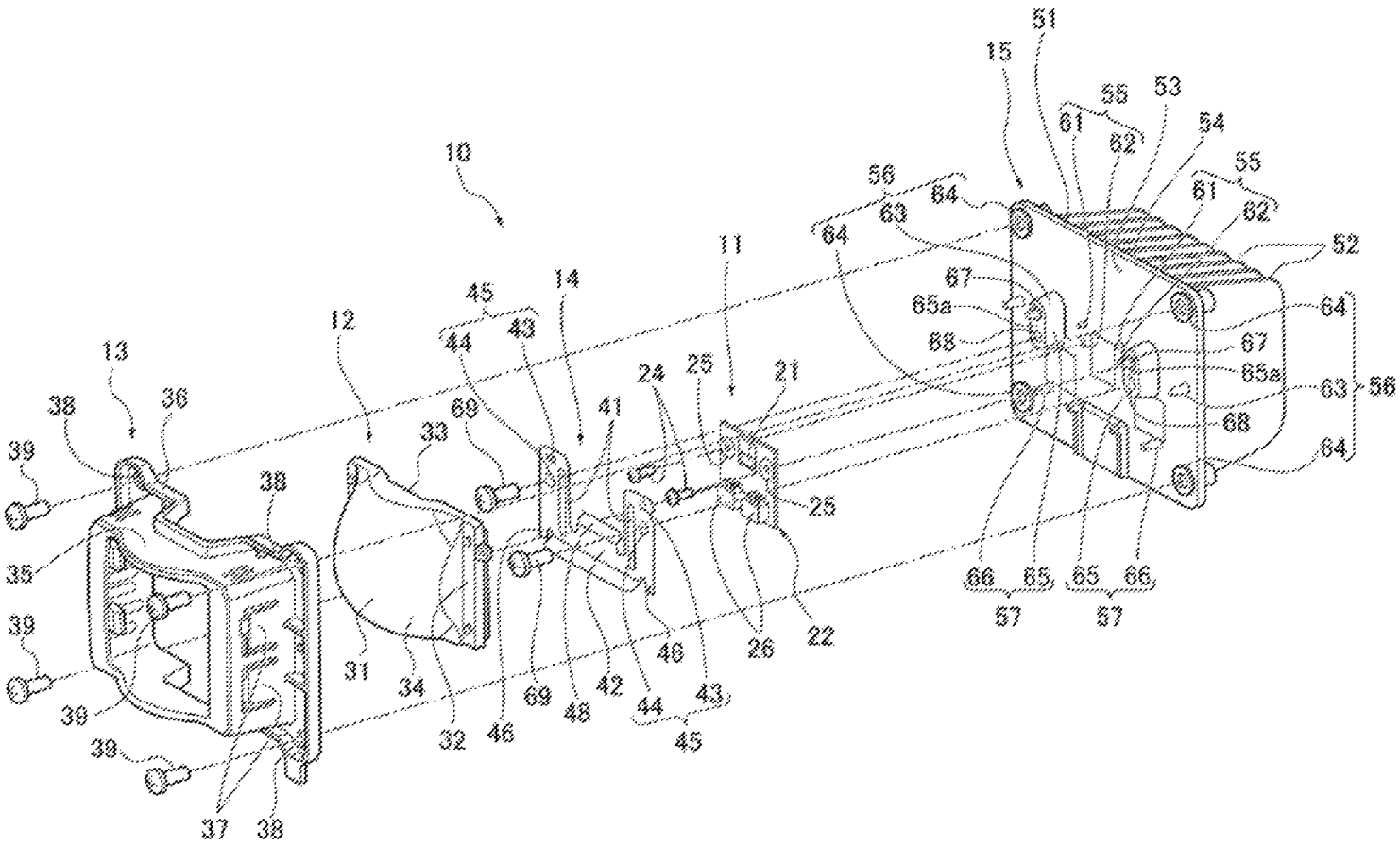
FIG. 2 is a schematic exploded perspective view of each configuration of the vehicle lamp.

As illustrated in FIGS. 1 and 2, the vehicle lamp 10 includes the light source unit 11 as the light source, the lens 12, a lens holder 13, an optical member 14, and a heat radiation member 15. A semiconductor light emitting element is used as the light source unit 11, and in the first embodiment, an LED package 21 configured as a member capable of turning on a housed LED (light emitting diode) is attached to a substrate 22. Note that the LED package 21 may include, for example, an organic light emitting (organic EL) (OLE) or an organic light emitting diode (OLED).

The substrate 22 is in a plate shape, and attachment holes 25 and positioning holes are provided on both of the right and left sides of the substrate 22. At the substrate 22, a terminal provided at the substrate 22 itself is connected to a terminal of the LED package 21 to fix the LED package 21, and connectors 26 for supplying power to the light source unit 11 (the LED package 21) are provided. The substrate 22 is attached to a later-described attachment surface 53 of the heat radiation member 15 with screws 24. In this manner, the light source unit 11 is attached to the heat radiation member 15 through the substrate 22 with the LED package 21 being positioned. Accordingly, the light source unit 11 is arranged such that an emission optical axis (an optical axis direction) of light is in a vehicle forward direction, and a light emitting surface of the LED package 21 is positioned in the vicinity of a rear focal point of the lens 12. At the light source unit 11, a harness is connected to the connectors 26, and power from a lighting control circuit is, for lighting, supplied to the LED package 21 through the substrate 22 as necessary.

The lens 12 is formed from a resin member, and has a lens portion 31 and flange portions 32. The lens portion 31 has an incident surface 33 facing the light source unit 11, and an emission surface 34 positioned on the vehicle front side. The lens portion 31 is configured such that light (direct light) emitted from the light source unit 11 enters the incident surface 33 and is emitted forward of the vehicle in a predetermined direction through the emission surface 34. The shapes (e.g., the curvatures) of both of the incident surface 33 and the emission surface 34 are set according to the light distribution pattern, and a predetermined light distribution pattern is formed by light having entered the lens portion 31 from the light source unit 11. The incident surface 33 includes a free-form surface, a quadric surface, a composite quadric surface, a combination thereof, or a flat surface, and is the flat surface as one example. Note that the incident surface 33 may be a convex surface protruding to a light source unit 11 side or a concave surface recessed to the opposite side of the light source unit 11. The emission surface 34 includes a free-form surface, a quadric surface, a composite quadric surface, or a combination thereof, and is a convex surface protruding to the opposite side of the light source unit 11. One or both of the incident surface 33 and the emission surface 34 may include multiple divided surfaces. The flange portions 32 are integrally provided on both sides of the lens portion 31 in the right-left direction. The flange portions 32 are spots for fixing the lens 12 to the lens holder 13.

The lens holder 13 includes a resin member having a lower coefficient of thermal conductivity (having a greater thermal resistance) than that of the heat radiation member 15. The lens holder 13 is entirely in a rectangular frame shape as viewed from the front side, and has a lens support portion 35 and an attachment plate portion 36. The lens support portion 35 is in a frame shape protruding forward of the attachment plate portion 36, opens at a front end wall, and is configured such that elastic support pieces 37 are each provided at both of right and left walls (only the left side is illustrated in FIG. 1). The lens support portion 35 has such a size that the entirety of the lens 12 including the flange portions 32 can be received by the lens support portion 35, and the opening of the front end wall has such a size that the lens portion 31 (the emission surface 34) can protrude from the opening.

At the lens holder 13, the lens 12 whose emission surface 34 faces the front side is inserted into the lens support portion 35 from the rear side to the front side. Accordingly, the flange portions 32 are sandwiched by a front wall of the lens support portion 35 and the elastic support pieces 37, and therefore, the lens 12 is positioned and supported. In this state, the lens portion 31 (the emission surface 34) of the lens 12 protrudes forward of an opening of a front end wall of the lens holder 13. The attachment plate portion 36 is in a plate shape surrounding the lens support portion 35, and is a spot to be placed on the later-described attachment surface 53 of the heat radiation member 15. At the attachment plate portion 36, attachment holes 38 are provided at four corners.

The optical member 14 controls light passing between the light source unit 11 and the lens 12. In the first embodiment, the optical member 14 is provided to prevent (block) irradiation of the connectors 26 with light having entered from the outside and condensed by the lens 12. Note that the optical member 14 may be, for example, one configured to block part of light emitted from the light source unit 11 and entering the lens 12, or may be one configured to reflect, toward the lens 12, part of light emitted from the light source unit 11 and not used for formation of the light distribution pattern for formation of an auxiliary light distribution pattern.

Figure 3:
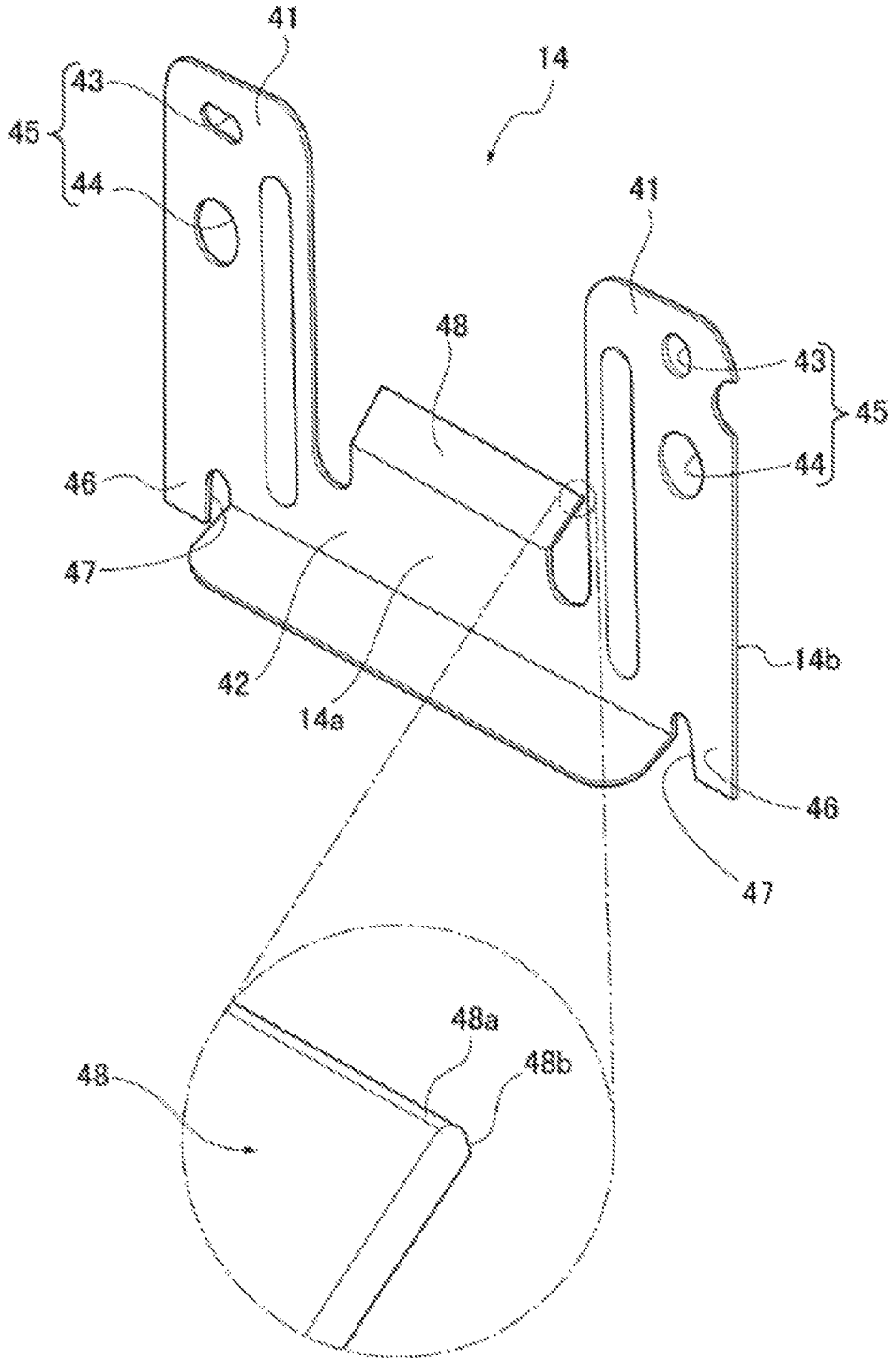
FIG. 3 is a view for describing the configuration of an optical member.

As illustrated in FIG. 3, the optical member 14 is a plate-shaped member, and in the first embodiment, is formed from a light non-permeable metal plate (e.g., a plated steel sheet or a steel sheet of SUS or aluminum). The optical member 14 has a pair of attachment piece s 41 elongated in the upper-lower direction and a coupling piece 42 coupling both attachment pieces 41 between lower end portions thereof, and is entirely in a U-shape as viewed from the front side. As described later, the optical member 14 is, as viewed from a lens 12 side (the front side), provided such that the attachment pieces 41 are positioned on both sides of the LED package 21 of the light source unit 11 in the right-left direction and the connectors 26 of the light source unit 11 are covered with the coupling piece 42 (see FIG. 5).

At each attachment piece 41, a positioning hole 43 and an attachment hole 44 are provided and arranged in the upper-lower direction in the vicinity of an upper end. The positioning hole 43 and the attachment hole 44 are used for fixing the optical member 14 to the later-described attachment surface 53 of the heat radiation member 15, and function as a fixing spot 45 for the attachment surface 53 (later-described fixing portions 65 thereof).

Moreover, at each attachment piece 41, a contact spot 46 is provided at an outer end portion of a lower end. The contact spot 46 is formed in such a manner that a slit 47 extending from the lower end of the attachment piece 41 in the upper-lower direction is provided, and is formed in such a protruding piece shape (a so-called tab shape) that only the upper side is connected to the attachment piece 41 and the lower side and both of the right and left sides are separated. As described above, at the optical member 14, the pair of fixing spots 45 is provided at one edge portion (an upper end portion), and the contact spots 46 are provided at the other edge portion (a lower end portion).

At the coupling piece 42, a bent piece 48 is provided in the middle of an upper end. The bent piece 48 is configured such that a flat plate-shaped spot protruding upward of the coupling piece 42 is bent toward the light source unit 11 side (the rear side). The bent piece 48 can cover the upper side of the connectors 26 without interfering with proper incidence of light emitted from the LED package 21 of the light source unit 11 into the lens 12 (the incident surface 33 thereof).

Figure 4:
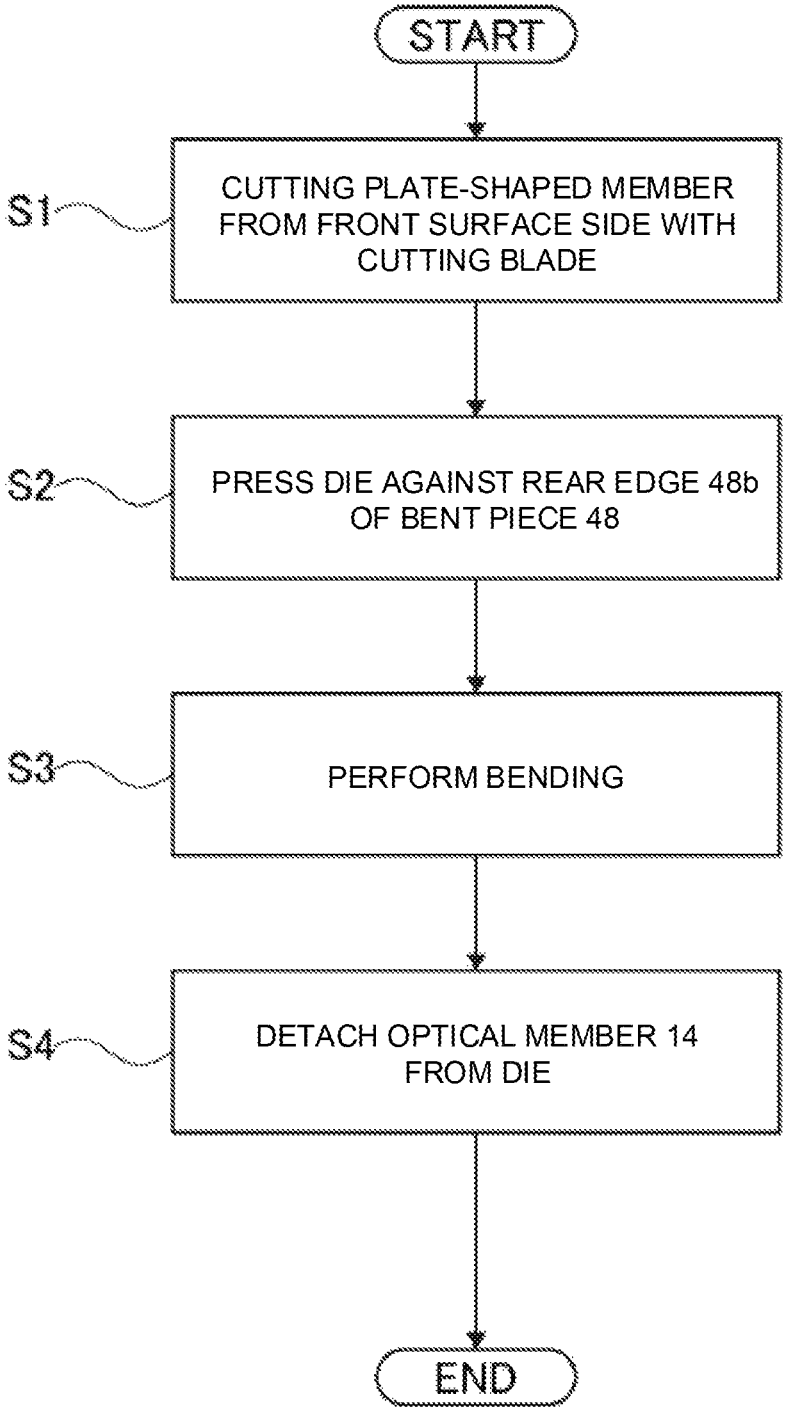
FIG. 4 is a flowchart of the steps of processing the optical member.

The optical member 14 is formed by punching of a plate-shaped member, and in the first embodiment, is formed through steps of a flowchart illustrated in FIG. 4.

At a step S1, the plate-shaped member is cut from a front surface (a lens-12-side surface (a front surface 14*a*) in a state in which the formed optical member 14 is attached) side with a cutting blade, and the processing proceeds to a step S2. At the step S1, a shape in which both attachment pieces 41 are coupled through the coupling piece 42, the fixing spots 45 are provided at both attachment pieces 41, and both contact spots 46 and the bent piece 48 are provided at the coupling piece 42 is formed from the plate-shaped member. At this point, the cutting blade is pressed against a front edge 48*a* (see FIGS. 3 and 6) as a front-surface-14*a*-side end portion of a tip end of the bent piece 48 to punch the front edge 48*a*, thereby forming a rounded shape (a so-called droop). There is a probability that a burr is formed at a rear edge 48*b* as a rear-surface-14*b*-side end portion of the tip end of the bent piece 48. For this reason, the processing of the step S2 is subsequently performed in the first embodiment.

At the step S2, a die is pressed against the rear edge 48*b* of the bent piece 48 to crush and chamfer the rear edge 48*b*, and the processing proceeds to a step S3.

At the step S3, the bending processing (formation of the lower end of the optical member 14, the bent piece 48, etc.) of bending the plate-shaped member into a predetermined shape as the optical member 14 is performed for the plate-shaped member shaped at the step S1 and chamfered at the rear edge 48*b* at the step S2, and the processing proceeds to a step S4.

At the step S4, the optical member 14 is detached from the die for punching, and this processing ends.

In this manner, the optical member 14 having the above-described shape can be obtained. At the tip end of the bent piece 48 of the optical member 14, the front edge 48*a* is in the rounded shape (the so-called droop), and the rear edge 48*b* is chamfered (see FIGS. 3 and 6).

As illustrated in FIG. 2, the heat radiation member 15 is a heat sink member configured to radiate heat generated at the light source unit 11 to the outside, and is made of die-cast aluminum or resin having thermal conductivity. The heat radiation member 15 has a base 51 in a plate shape perpendicular to the front-rear direction and multiple heat radiation fins 52 provided integrally with the base 51. The base 51 is configured such that a front surface thereof in the front-rear direction is the attachment surface 53 to be attached to the light source unit 11, the lens holder 13, and the optical member 14 and each heat radiation fin 52 is provided on a rear surface 54 as a rear surface in the front-rear direction. Thus, the heat radiation member 15 functions as a fixing member to be fixed to the light source unit 11. In the first embodiment, the attachment surface 53 is along a plane perpendicular to the front-rear direction. Each heat radiation fin 52 is a spot for radiating heat to the outside. The heat radiation fins 52 are in a plate shape extending in the upper-lower direction and the front-rear direction, and are arranged in the right-left direction.

The attachment surface 53 is configured such that light source attachment portions 55 are provided at a center portion, lens attachment portions 56 are provided at a peripheral edge portion, and a member attachment portion 57 is provided between the light source attachment portion 55 and the lens attachment portion 56. The light source attachment portion 55 is a spot for attachment of the light source unit 11, and has a positioning protrusion 61 to be inserted into the positioning hole of the substrate 22 and a screw hole 62 facing the attachment hole 25 of the substrate 22. The lens attachment portion 56 is a spot for attachment of the lens holder 13, and has a positioning protrusion 63 to be inserted into a positioning hole of each attachment plate portion 36 of the lens holder 13 and a screw hole 64 facing the attachment hole 38 of each attachment plate portion 36.

The member attachment portion 57 is a spot for attachment of the optical member 14. The member attachment portions 57 have a pair of fixing portions 65 provided at positions paired in the right-left direction with the light source unit 11 (the light source attachment portions 55) as the light source being interposed therebetween, and a pair of contact portions 66 provided at positions apart from the light source unit 11 in a direction (the upper-lower direction) perpendicular to a straight line connecting both fixing portions 65. Each fixing portion 65 is provided at a position corresponding to each fixing spot 45 of the optical member 14. Each contact portion 66 is, below each fixing portion 65, paired with each fixing portion 65, and is provided at a position corresponding to each contact spot 46 of the optical member 14.

Each fixing portion 65 is formed to protrude in a frustum shape from the attachment surface 53 to the front side in the front-rear direction, and a front protruding end surface 65*a* is a flat surface parallel to the attachment surface 53. Each protruding end surface 65*a* is a spot where each fixing spot 45 of the optical member 14 is placed. For each fixing portion 65, a protruding amount (a height dimension) from the attachment surface 53 to the protruding end surface 65*a* is set such that the placed optical member 14 is at an optically-proper position with respect to the light source unit 11 (the LED package 21) provided on the attachment surface 53. Such a proper position indicates proper action of the function set for the optical member 14, and in the first embodiment, indicates that irradiation of the connectors 26 with light condensed by the lens 12 is reliably prevented. Each protruding end surface 65*a* has a positioning protrusion 67 to be inserted into the positioning hole 43 of each attachment piece 41 of the optical member 14 and a screw hole 68 facing the attachment hole 44 of each attachment piece 41. Each screw hole 68 can receive a screw 69 as a fastening member corresponding to the screw hole 68 itself for attachment of the optical member 14 without reaching a rear surface 54 side, and the screw 69 does not protrude from the rear surface 54 side (see FIG. 6). In other words, the screw 69 screwed into each screw hole 68 has such a length dimension that the screw 69 is in each fixing portion 65 having the above-described protruding amount while the attachment strength of the optical member 14 is taken into consideration. Each contact portion 66 is formed to protrude in a rod shape from the attachment surface 53 to the front side in the front-rear direction, and the protruding amount (the height dimension) thereof from the attachment surface 53 is greater than those of both fixing portions 65.

As described below, the vehicle lamp 10 is configured such that the light source unit 11, the optical member 14, and the lens holder 13 are assembled with the attachment surface 53 of the heat radiation member 15. First, the screws 24 inserted into the attachment holes 25 of the substrate 22 are screwed into the screw holes 62 in a state in which the positioning protrusions 61 are inserted into the positioning holes of the light source attachment portions 55 of the attachment surface 53, and in this manner, the substrate 22 is positioned and attached. Accordingly, the light source unit 11 (the LED package 21) is provided with the light source unit 11 being positioned at the center portion of the attachment surface 53.

Thereafter, at the member attachment portions 57 of the attachment surface 53, the fixing spot 45 of each attachment piece 41 of the optical member 14 is placed on the protruding end surface 65*a* of each fixing portion 65 in a state in which the positioning protrusion 67 of each fixing portion 65 is inserted into the corresponding positioning hole 43 of the optical member 14, and the contact spot 46 of each coupling piece 42 of the optical member 14 is placed on each contact portion 66 (a protruding end thereof). In this state, the processing is performed in a state in which the heat radiation member 15 is placed with the attachment surface 53 facing upward in the vertical direction, and in this manner, the optical member 14 can be stably placed on two fixing portions 65 (the protruding end surfaces 65*a*) and two contact portions 66 (the protruding ends). Then, at the member attachment portions 57, the screws 69 inserted into the attachment holes 44 are screwed into the corresponding screw holes 68 of the optical member 14, and in this manner, the optical member 14 is positioned and attached. Accordingly, on the front side with respect to the light source unit 11, the optical member 14 is provided on the attachment surface 53 to surround the LED package 21 of the light source unit 11 as viewed from the front side (see FIG. 5).

Figure 5:
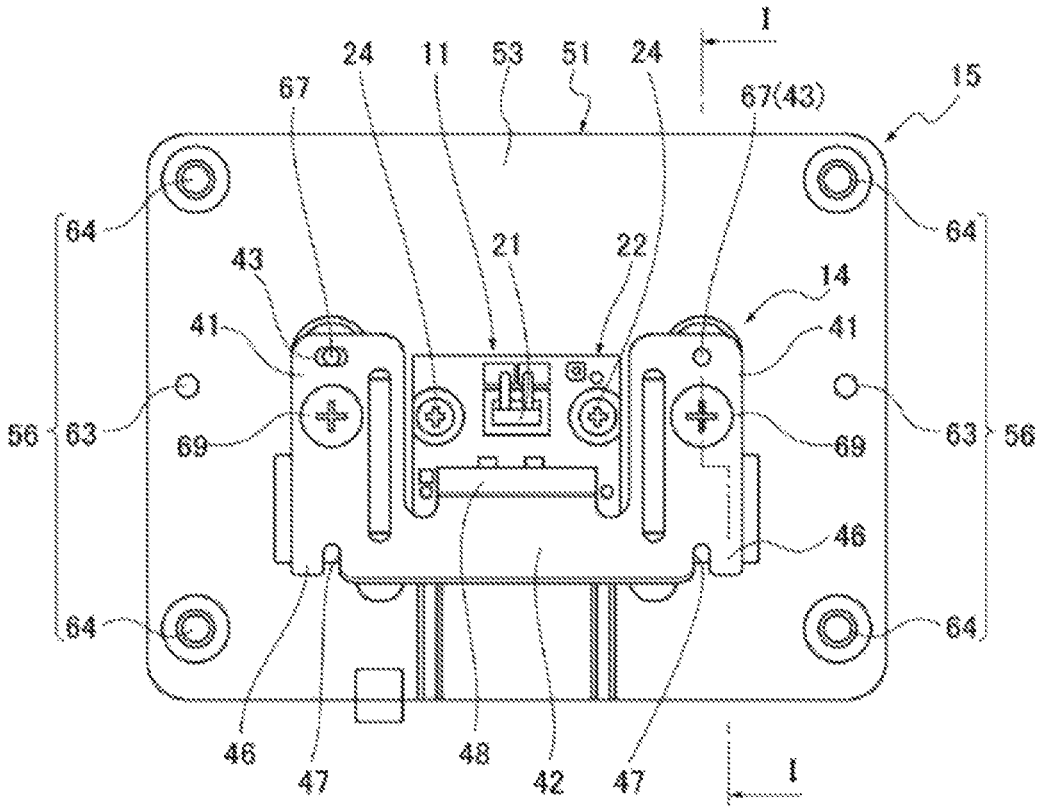
FIG. 5 is a front view of the state of an attachment surface of a heat radiation member to which a light source unit and the optical member are attached from a lens side.
Figure 6:
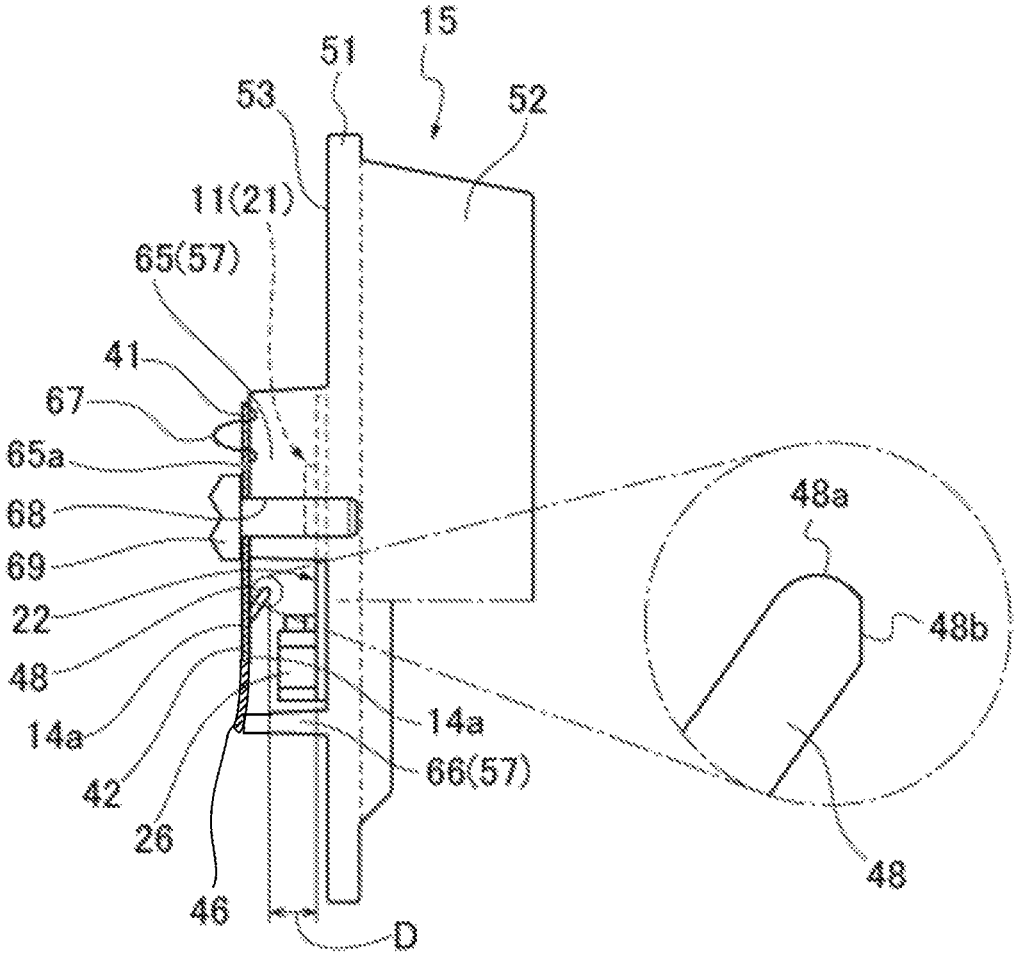
FIG. 6 is a view for describing a section along an I-I line illustrated in FIG. 5.
Figure 7:
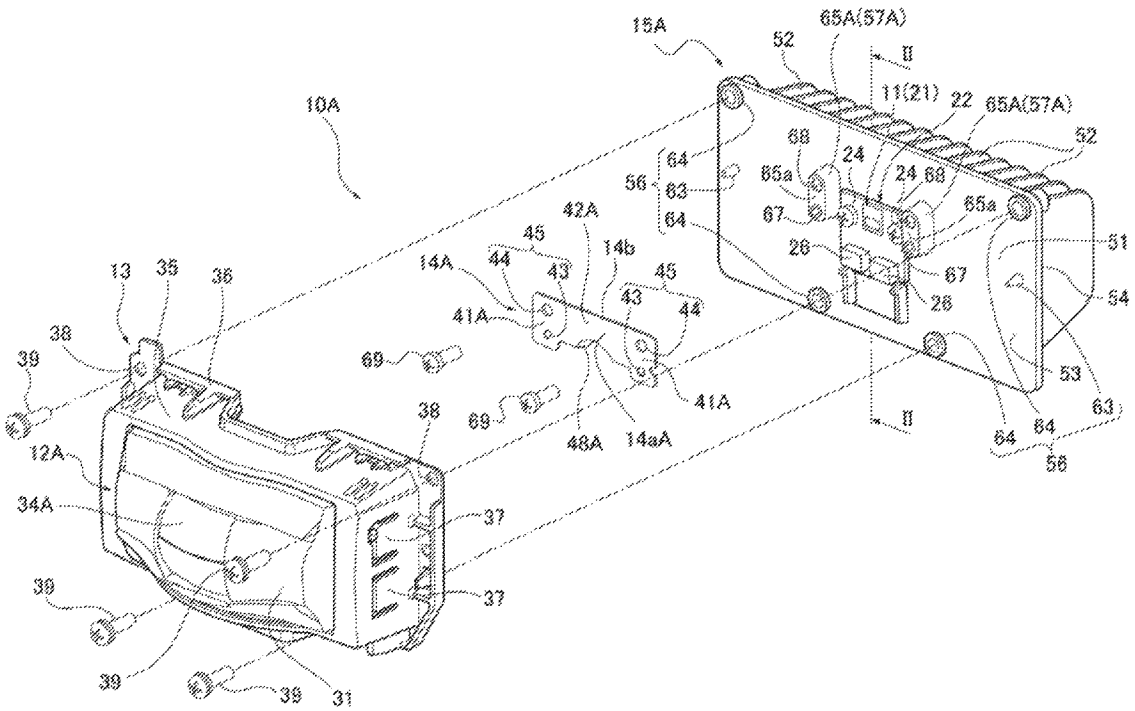
FIG. 7 is a schematic exploded perspective view of each configuration of a vehicle lamp as another example.
Figure 8:
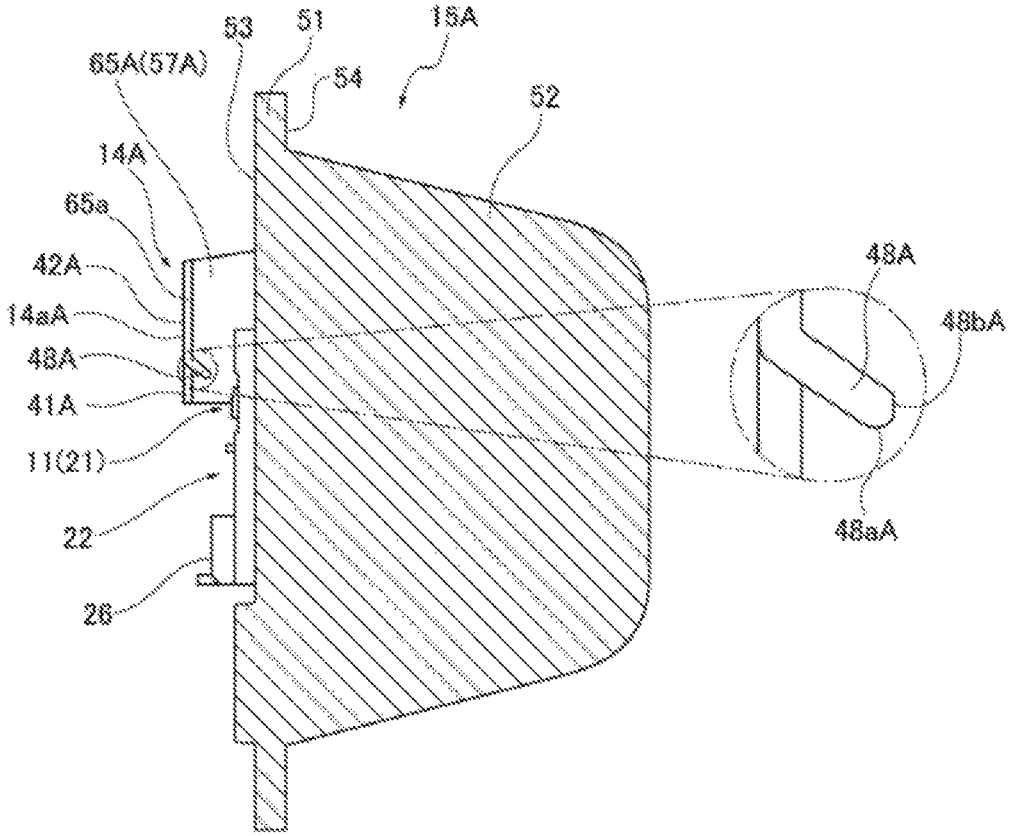
FIG. 8 is a view for describing the section of a heat radiation member to which a light source unit and a heat radiation member are attached along an II-II line of FIG. 7.

The protruding amount from the attachment surface 53 at the member attachment portion 57 is greater at each contact portion 66 than at both fixing portions 65, and therefore, when each fixing spot 45 is fixed to the protruding end surface 65*a* of each fixing portion 65, the contact spot 46 of the optical member 14 is pressed against each contact portion 66 (the protruding end) due to the elasticity of the contact spot 46 itself. In this state, the position of the optical member 14 in the front-rear direction is defined by the protruding end surface 65*a* of each fixing portion 65, and the position of the optical member 14 in the upper-lower direction and the right-left direction is defined by each positioning protrusion 67 and each positioning hole 43. Moreover, for each fixing portion 65, the protruding amount from the attachment surface 53 to the protruding end surface 65*a* is set as described above, and therefore, the optical member 14 is provided at the optically-proper position with respect to the light source unit 11 (the LED package 21). In this state, the optical member 14 is, as illustrated in FIGS. 5 and 6, in such a position relationship that the coupling piece 42 covers the front side of the connectors 26 of the light source unit 11 and the bent piece 48 protruding upward of the coupling piece 42 and bent backward covers the upper side of the connectors 26. Moreover, the bent piece 48 of the optical member 14 is configured such that the rear edge 48*b* and the light source unit 11 have a clearance D (see FIG. 6) in the front-rear direction.

Thereafter, the lens 12 is attached to the lens holder 13. Then, at the lens attachment portion 56 of the attachment surface 53, a screw 39 inserted into each attachment hole 38 is screwed into the corresponding screw hole 64 of the attachment plate portion 36 in a state in which each positioning protrusion 63 is inserted into the corresponding positioning hole of the attachment plate portion 36 of the lens holder 13, and accordingly, the lens holder 13 is positioned and attached. In this manner, the lens 12 supported on the lens holder 13 is provided at a proper position in the front of the light source unit 11 (the LED package 21) on the attachment surface 53.

The vehicle lamp 10 is assembled as described above such that the harness is connected to the connectors 26 of the light source unit 11, and power from the lighting control circuit is supplied to the LED package 21 through the substrate 22 to turn on the LED package 21 (the light emitting surface thereof) as necessary. By such lighting, light from the LED package 21 enters the lens portion 31 through the incident surface 33 of the lens portion 31 of the lens 12 and is emitted from the emission surface 34. Accordingly, the vehicle lamp 10 irradiates the front of the vehicle with the predetermined light distribution pattern (e.g., a low beam light distribution pattern, a high beam light distribution pattern). In this state, heat generated from the light source unit 11 is radiated to the outside through each heat radiation fin 52 of the heat radiation member 15 attached to the light source unit 11. Even when external light enters the emission surface 34 and light condensed by the lens 12 advances into the incident surface 33, the vehicle lamp 10 can prevent irradiation of the connectors 26 by the coupling piece 42 covering the front side of the connectors 26 and the bent piece 48 covering the upper side of the connectors 26.

Both fixing portions 65 described herein are for fixing the optical member 14 configured to control light passing between the light source unit 11 and the lens 12, and therefore, are preferably provided at the periphery of the light source unit 11 for providing versatility. Moreover, at the periphery of the light source unit 11 (the LED package 21), various components (e.g., the above-described connectors 26) are provided for turning on the light source unit 11, and therefore, a position which can be utilized for fixing the optical member 14 is limited. The optical member 14 covers the connectors 26 with the coupling piece 42 and the bent piece 48, and therefore, extends to below both fixing portions 65. Thus, if no contact portions 66 are provided in the first embodiment, the optical member 14 is in a so-called cantilever state in which the optical member 14 is fixed only in the vicinity of an upper end with two screws 69 (the attachment holes 44), and a clearance between a line connecting these two points and the center of gravity is great. In this state, there is a probability that a portion closer to a lower end side of the optical member 14 causes greater vibration and such vibration provides influence on the light distribution pattern to be irradiated.

For this reason, in the vehicle lamp 10, the pair of contact portions 66 is provided at the positions apart from the light source unit 11 in the direction (the upper-lower direction) perpendicular to the line connecting both fixing portions 65, and contact both contact spots 46 provided at an outer lower end of the optical member 14. With this configuration, the optical member 14 can be supported at four points to surround the center of gravity in the vehicle lamp 10, and vibration of the optical member 14 can be substantially reduced. Moreover, in the vehicle lamp 10, by setting the protruding amounts of both fixing portions 65 and both contact portions 66, each contact spot 46 is pressed against each contact portion 66 by means of the elasticity of the optical member 14, and therefore, these points serve as support points. Thus, for the vehicle lamp 10, support at four points can be realized only by two screws 69, and the members can be reduced while a simple configuration can be realized. Further, in the vehicle lamp 10, both contact portions 66 protrude in the rod shape from the attachment surface 53. Thus, the vehicle lamp 10 is configured so that the occupation area of both contact portions 66 in the attachment surface 53 can be decreased and setting of the positions of both contact portions 66 can be facilitated.

The vehicle lamp 10 of the first embodiment can obtain each of the following features and advantageous effects.

In the vehicle lamp 10, the pair of fixing portions 65 provided at the positions paired with the light source unit 11 as the light source being interposed therebetween and the contact portions 66 provided to protrude from the attachment surface 53 at the positions apart from the light source unit 11 in the direction perpendicular to the line connecting both fixing portions 65 are provided on the attachment surface 53. Moreover, in the vehicle lamp 10, the protruding amount of the contact portion 66 from the attachment surface 53 in the front-rear direction (the optical axis direction) is greater than that of the fixing portion 65, the pair of fixing spots 45 provided at one edge portion (the upper end portion in the first embodiment) of the optical member 14 is fixed to the fixing portions 65 with the screws 69, and the contact spots 46 provided at the other edge portion (the lower end portion in the first embodiment) of the optical member 14 contact the contact portions 66. Thus, in the vehicle lamp 10, both fixing spots 45 at one edge portion of the optical member 14 can be fixed to the fixing portions 65 while the contact spots 46 at the other edge portion can be pressed against the contact portions 66, and the optical member 14 can be supported such that the center of gravity thereof is surrounded. With this configuration, the vehicle lamp 10 is configured so that, e.g., vibration of the optical member 14 can be substantially reduced and the light distribution pattern as designed can be formed. In addition, the probability of emitting unintended light can be substantially reduced, and product quality can be improved. Particularly, the vehicle lamp 10 is configured such that the contact portions 66 are also provided in a pair below each fixing portion 65, and therefore, support at four points can be realized such that the center of gravity of the optical member 14 is surrounded and the attachment strength of the optical member 14 can be improved.

In the vehicle lamp 10, the contact spot 46 is formed in such a protruding piece shape that only one of four sides crossing each other is connected to the attachment piece 41. Thus, in the vehicle lamp 10, deflection of the optical member 14 due to pressing of the contact spot 46 against the contact portion 66 can be kept only at the contact spot 46 or the periphery thereof, and influence on light passing between the light source unit 11 controlled by the optical member 14 and the lens 12 can be reduced to the minimum.

In the vehicle lamp 10, one end portions (the lower end portions in the first embodiment) of the pair of attachment pieces 41 are connected to each other through the coupling piece 42 to form the optical member 14. Moreover, in the vehicle lamp 10, the fixing spot 45 is provided at the other end portion (the upper end portion in the first embodiment) of each attachment piece 41, and the contact spot 46 is provided at one end portion of the attachment piece 41. Thus, the vehicle lamp 10 is configured so that the light source unit 11 (the LED package 21) can be surrounded as viewed from the front and electronic components (the connectors 26 of the light source unit 11 in the first embodiment) provided at the periphery of the light source unit 11 can be covered with the coupling piece 42. Thus, these electronic components can be protected.

In the vehicle lamp 10, the rear edge 48*b* facing the light source unit 11 is chamfered in the front-rear direction (the optical axis direction) at the bent piece 48 provided at the coupling piece 42 of the optical member 14. Thus, the vehicle lamp 10 is configured so that the clearance between the bent piece 48 (the rear edge 48*b*) and the light source unit 11 can be a predetermined value (the clearance D in the first embodiment). With this configuration, the vehicle lamp 10 is configured so that short circuit between an electrode terminal as an electric circuit for the light source unit 11 and the bent piece 48 can be prevented, for example. This is because of the following reason. In the first embodiment, in the vehicle lamp 10, the cutting blade contacts the plate-shaped member from a front surface 14*a* side thereof to shape the optical member 14, and the front edge 48*a* of the bent piece 48 is formed in the rounded shape (the so-called droop). This is for preventing light reflection in an unintended direction due to a burr formed at the front edge 48*a* of the bent piece 48 because the vehicle lamp 10 is configured such that the front-surface-14*a*-side surface of the bent piece 48 is in such a position relationship that such a surface can contact light passing between the light source unit 11 and the lens 12. In the case of contact of the cutting blade from the front surface 14*a* side, there is a probability that the burr is formed at the rear edge 48*b* of the bent piece 48 in the vehicle lamp 10, and it is difficult to manage the size and shape of such a burr. For this reason, there is a probability that a clearance between a tip end of the burr and the light source unit 11 is equal to or less than a predetermined value, and there is a probability that short circuit between the rear edge 48*b* and the light source unit 11 (e.g., the electrode terminal thereof) is caused through the burr. However, in the vehicle lamp 10, the rear edge 48*b* is chamfered, and therefore, the clearance between the bent piece 48 (the rear edge 48*b*) and the light source unit 11 can be the predetermined value.

In the vehicle lamp 10, each fixing portion 65 sets the position of the optical member 14 with respect to the light source unit 11 in the optical axis direction. Thus, the optical member 14 is merely attached to each fixing portion 65 (each member attachment portion 57) in the vehicle lamp 10 so that the optical member 14 can be provided at a proper position with respect to the light source unit 11. Particularly, the protruding end surfaces 65*a* of both fixing portions 65 are the flat surfaces in the vehicle lamp 10, and therefore, the positioning accuracy of the optical member 14 in the optical axis direction can be enhanced. Moreover, in the vehicle lamp 10, each fixing portion 65 receives the screw 69 without protruding from the rear surface 54 side provided with the multiple heat radiation fins 52. Thus, in the vehicle lamp 10, no spot where each fixing portion 65 configured to receive the screw 69 protrudes from the rear surface 54 of the base 51 is formed at the heat radiation member 15. Thus, a convection flow among the heat radiation fins 52 can be smoothly generated, and the light source unit 11 can be properly cooled. This is more effective because each heat radiation fin 52 of the heat radiation member 15 faces the rear side in the front-rear direction in the vehicle lamp 10 and generation of the convection flow is easily interfered if a protrusion corresponding to each fixing portion 65 is present between the heat radiation fins 52. Thus, the vehicle lamp 10 leads to enhancement of cooling performance of the heat radiation member 15, and therefore, enlargement of the heat radiation member 15 can be suppressed. Consequently, the vehicle lamp 10 can contribute to downsizing of the entire configuration.

Thus, in the vehicle lamp 10 of the first embodiment as the vehicle lamp according to the present disclosure, fixing at the optical member 14 provided between the light source unit 11 (the light source) and the lens 12 can be realized with a simple configuration, and vibration can be reduced.

The vehicle lamp of the present disclosure has been described above based on the first embodiment, but a specific configuration is not limited to the first embodiment. For example, design changes and additions are allowed without departing from the gist of the invention according to each claim.

For example, in the first embodiment, the vehicle lamp 10 using the optical member 14 configured to prevent (block) irradiation of the connectors 26 with light having entered from the outside and condensed by the lens 12 has been described. However, as long as the vehicle lamp uses the optical member configured to control light passing between the light source unit 11 and the lens 12, the present disclosure is not limited to the configuration of the first embodiment. For example, a vehicle lamp 10A illustrated in FIGS. 7 and 8 may be employed. In terms of a basic configuration, the vehicle lamp 10A is identical to the vehicle lamp 10, except that the configuration of an optical member 14A and the shape of a lens 12A are different. Hereinafter, a configuration different from that of the vehicle lamp 10 will be described. The lens 12A of the vehicle lamp 10A forms a light distribution pattern different from that of the vehicle lamp 10 (the lens 12 thereof), and the shapes of an incident surface (33) and an emission surface 34A are different.

The optical member 14A is configured such that upper portions of a pair of attachment pieces 41A are coupled to each other through a coupling piece 42A, and is in a plate shape provided above the light source unit 11. The optical member 14A has a bent piece 48A not covering the connectors 26 of the light source unit 11 but formed as a conical reflection surface surrounding the substantially upper half of the light source unit 11. The bent piece 48A may be a reflection surface formed in such a manner that, e.g., surface treatment is performed for a front-surface-14*a*A-side surface to form a surface having a higher reflectance than those of other surfaces of the optical member 14A. The bent piece 48A guides part, which is not light directly entering the lens 12A through the incident surface 33A thereof and forming the light distribution pattern, of light emitted from the light source unit 11 to the lens 12A (the incident surface 33A thereof), and emits such light from the lens 12A (the emission surface 34A thereof). In this manner, the auxiliary light distribution pattern different from the light distribution pattern is formed.

In addition, in the vehicle lamp 10A, member attachment portions 57A of a heat radiation member 15A include only a pair of fixing portions 65A. Each fixing portion 65A has a configuration similar to that of the fixing portion 65 of the first embodiment, but has a vertically-inverted configuration. When the optical member 14A is attached with screws 69 as fastening members, the optical member 14A is at an optically-proper position with respect to the light source unit 11. As in the optical member 14 of the first embodiment, a cutting blade contacts a plate-shaped member from a front surface 14*a*A side, and in this manner, the optical member 14A is in a shape having the bent piece 48A as the above-described conical reflection surface for the substantially upper half and a front edge 48*a*A of the bent piece 48A is in a rounded shape (a so-called droop). Thereafter, as in the optical member 14 of the first embodiment, a die is pressed against a rear edge 48*b*A of the bent piece 48A to crush and chamfer the rear edge 48*b*A.

Regarding the configuration similar to that of the vehicle lamp 10 of the first embodiment, the vehicle lamp 10A can obtain similar advantageous effects. The vehicle lamp 10A is configured such that the bent piece 48A as the reflection surface is provided at the optical member 14A. Thus, the cutting blade contacts to perform processing from the front surface 14*a*A side, and in this manner, the front edge 48*a*A is in the rounded shape. Consequently, it is more effective because the auxiliary light distribution pattern can be more properly formed. Note that in the vehicle lamp 10A, the optical member 14A is in the plate shape provided above the light source unit 11, but as in the lens 12, may be in a shape extending to below the light source unit 11 to cover the connectors 26 of the light source unit 11. In this case, the contact spots 46 similar to those of the optical member 14 are provided at the optical member 14A, and the contact portions 66 similar to those of the member attachment portions 57 are provided at the member attachment portions 57A. With this configuration, support at four points can be realized such that the center of gravity is surrounded as in the vehicle lamp 10, and the advantageous effects similar to those of the vehicle lamp 10 can be obtained.

In the first embodiment and the above-described example, the optical members 14, 14A have been described, but the present disclosure is not limited to each of the above-described configurations as long as the optical member is the plate-shaped member configured to control light passing between the light source unit 11 and the lens 12.

In the first embodiment, the protruding piece-shaped contact spots 46 are provided in a pair at both ends of the lower end of the optical member 14, but one or three or more contact spots 46 may be provided as long as the contact spot(s) 46 is provided for the pair of fixing spots 45 at the position sandwiching the center of gravity of the optical member 14. The present disclosure is not limited to the configuration of the first embodiment. Moreover, the contact spot 46 is formed adjacent to the slit 47, but may be provided to partially protrude from the coupling piece 42 as long as the contact spot 46 is formed in such a protruding piece shape that only one of four sides crossing each other is connected to the coupling piece 42. Other configurations may be employed, and the present disclosure is not limited to the configuration of the first embodiment.

In the first embodiment and the above-described example, the fixing member is the heat radiation member 15, but the present disclosure is not limited to the configuration of the first embodiment as long as the fixing member is fixed to the light source unit 11.

REFERENCE SIGNS LIST

10 vehicle lamp
11 light source unit (as one example of light source)
12 lens
14 optical member
15 heat radiation member (as one example of fixing member)
41 attachment piece
42 coupling piece
45 fixing spot
46 contact spot
48, 48A bent piece
52 heat radiation fin
53 attachment surface
65 fixing portion
66 contact portion
69 screw (as one example of fastening member)

The invention claimed is:

1. A vehicle lamp comprising:

a light source provided on an attachment surface of a fixing member;

a lens configured to forwardly irradiate light directly entered from the light source; and an optical member having a plate shape, provided between the light source and the lens, wherein the attachment surface includes a pair of fixing portions provided at positions paired with the light source being interposed therebetween and a contact portion provided protrusively from the attachment surface at a position apart from the light source in a direction perpendicular to a straight line connecting the pair of fixing portions, a protruding amount of the contact portion from the attachment surface in an optical axis direction of the light source is greater than that of each of the pair of fixing portions, the optical member is provided with a pair of fixing spots provided at one edge portion of the optical member and a contact spot provided at another edge portion of the optical member, the pair of fixing spots being fixed to the pair of fixing portions through a fastening member, and the contact spot contacting the contact portion, the optical member is configured such that a pair of attachment pieces having the pair of fixing spots is connected to each other through a coupling piece, and the contact spot is provided at a coupling-piece-side end portion of the pair of attachment pieces, and is formed in a protruding piece shape such that only one of four sides crossing each other is connected to the pair of attachment pieces.

2. The vehicle lamp according to claim 1, wherein the coupling piece includes a bent piece bent toward an attachment surface side, and the bent piece is chamfered at a spot facing the light source in the optical axis direction.

3. The vehicle lamp according to claim 1, wherein the fixing member is a heat radiation member configured to radiate heat from the light source, and is provided with multiple heat radiation fins on a rear surface of the attachment surface, and the pair of fixing portions set a position of the optical member with respect to the light source in the optical axis direction while receiving the fastening member in such a way that the fastening member does not protrude to a rear side of the fixing member.

* * * * *